United States Patent [19]

Knapp et al.

[11] Patent Number: 4,513,500

[45] Date of Patent: Apr. 30, 1985

[54] METHOD OF FORMING A WIRE SPLICE

[76] Inventors: Frank W. Knapp; Caroline M. Knapp, both of Box 289, Mineral Point, Wis. 53565

[21] Appl. No.: 551,676

[22] Filed: Nov. 14, 1983

[51] Int. Cl.[3] ..... H01R 43/00

[52] U.S. Cl. ..... 29/885; 29/459; 29/517; 403/284

[58] Field of Search ..... 29/885, 958, 459, 517, 29/518; 174/84 C; 403/284

[56] References Cited

U.S. PATENT DOCUMENTS 1,909,344 5/1933 Green et al. .
1,936,185 11/1933 Brenizer .
2,038,535 4/1936 Brenizer .
2,244,109 6/1941 Klein .
2,560,411 7/1951 Burns .
2,716,275 8/1955 Matthysse .
3,475,545 10/1969 Stark et al. .
4,241,490 12/1980 Edwards .

*Primary Examiner*—Howard N. Goldberg
*Assistant Examiner*—Carl J. Arbes
*Attorney, Agent, or Firm*—Tilton, Fallon, Lungmus & Chestnut

[57] ABSTRACT

The method for producing a sleeve or ferrule for use in joining together the ends of strands of high tensile strength, single strand wire of any gauge from 12 to 18 gauge.

6 Claims, 9 Drawing Figures

METHOD OF FORMING A WIRE SPLICE

BACKGROUND OF THE INVENTION

There is a definite need for an anti-electrolytic steel sleeve for splicing the ends of high tensile strength wire together which will withstand pressure forces of about 1300 pounds and securely hold the wires in the sleeve. These wires are usually 12 to 18 gauge. This has not been accomplished before and the splice or sleeve of the present invention was conceived to accomplish this and other objectives.

SUMMARY OF THE INVENTION

The method of cutting short lengths of cold rolled and drawn tubing into small sleeves, then deburring or chamfering the individual sleeves at both ends; interiorly threading each one, then forming each tube into an oval shape; then heat treating each to a specific hardness; then putting a coating of zinc thereon, and finally coating each sleeve with an olive drab chromium finish.

DETAILED DESCRIPTION OF THE INVENTION

Figure 1:
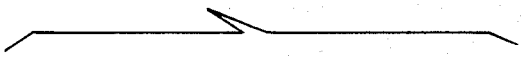
FIG. 1 is a side elevational view of a length of tubing and illustrating sleeves cut therefrom.
Figure 2:
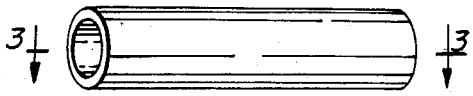
FIG. 2 is a perspective view of the cut sleeves enlarged.

The method of forming a sleeve or ferrule for joining two pieces of high tensile strength wire comprising taking an elongated piece of cold rolled and drawn steel tubing having a specific inner dimension and a specific outer diameter and cutting said tubing into small sleeves or ferrules of from one to one and one-half inches long, as shown in FIG. 1.

Figure 3:
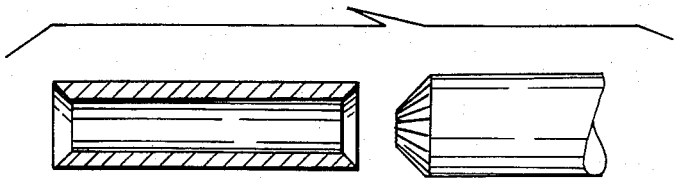
FIG. 3 is a cross-sectional view taken on the lines 3—3 of FIG. 2 and illustrating chamfering of one end, the other end being already chamfered.
Figure 4:
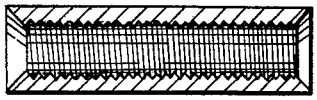
FIG. 4 is a cross-sectional view showing the interior of the sleeve threaded.
Figure 5:
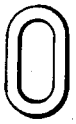
FIG. 5 is an end elevational view of the sleeve having been formed into an oval shape.

Then deburring or chamfering both ends (see FIG. 3). Then threading the inside of each sleeve (see FIG. 4). Then forming each sleeve into an oval shape. Then heat treating said sleeves to 30 to 32 on the Rockwell Hardness Scale.

Then placing a coating of zinc plating of 0.0003 to 0.0005 inches on each sleeve and ending with a coating of olive drab chromium finish.

Figure 6:
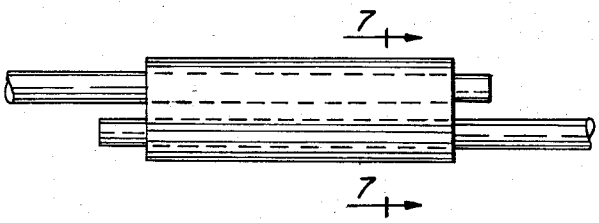
FIG. 6 is a side elevational view of the sleeve having the ends of the fencing wire inserted therein.
Figure 7:
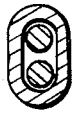
FIG. 7 is a cross-sectional view taken on the lines 7—7 of FIG. 6.
Figure 8:
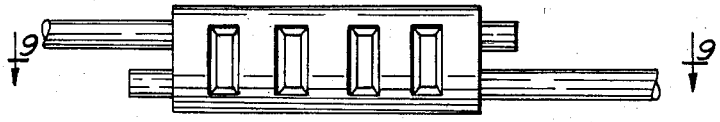
FIG. 8 is a top elevational view of the sleeve and wires of FIG. 7 shown crimped in four places.
Figure 9:
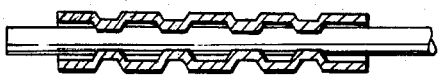
FIG. 9 is a cross-sectional view taken on the lines 9—9 of FIG. 8.

In applying the sleeve, the ends of wire fencing are inserted through the sleeve as seen in FIG. 6 and the ferrule is crimped in four or five places as shown in FIGS. 8 and 9.

When ordinary lead or lead alloy ferrules are used, they can expand and contract with changes in temperature, and hence fail to hold the splice, whereas the device of the present invention is the same composition as the wire.

The device of the present invention is a good conductor of electricity when used in an electric fencing system and is anti-electrolytic, being the same metal composition as the wire.

Since the sleeve is made of the same material as the fencing wires that are spliced together, the sleeve will last as long as the fencing wire, which is an additional feature of the splice.

For making the ferrules or sleeves for use with $12\frac{1}{2}$ gauge wire, the sleeve should have an inside diameter of about 0.190 to 0.196 inches.

Although but one specific embodiment of this invention is herein shown and described, it is to be understood that numerous details of the construction shown may be altered or omitted without departing from the spirit of the invention as defined by the following claims.

We claim:

1. The method of producing sleeves or ferrules for joining a pair of wires together comprising:

(a) taking a piece of cold rolled and drawn steel tubing having a specific outer diameter and a specific inner diameter;

(b) then deburring each end and threading the inside of each sleeve;

(c) then forming each sleeve into an oval shape;

(d) then heat treating each sleeve;

(e) then zinc plating each piece, and then coating each sleeve with an olive drab chromium finish.

2. The method according to claim 1 wherein each sleeve is from one to one and one-half inches in length.

3. The method according to claim 2 wherein the inside diameter of the sleeve is 0.190 to 0.196 inches for $12\frac{1}{2}$ gauge wire sleeves.

4. The method according to claim 3 wherein each sleeve is heat treated to 30 to 32 on the Rockwell Hardness Scale.

5. The method according to claim 5 wherein the zinc plate coating is from 0.0003 to 0.0006 inches.

6. The method of claim 1 wherein the ferrule is made from 12 to 18 gauge tubing.

* * * * *